US005694860A

United States Patent [19]

Xiao

[11] Patent Number: 5,694,860

[45] Date of Patent: Dec. 9, 1997

[54] FOLDABLE TABLE AND BACKPACK APPARATUS

[76] Inventor: Ji Xiao, 2540 S. Maryland Pkwy., Box 159, Las Vegas, Nev. 89109

[21] Appl. No.: 702,142

[22] Filed: Aug. 23, 1996

[51] Int. Cl.[6] ..... A47B 3/00

[52] U.S. Cl. ..... 108/38; 224/153; 108/48

[58] Field of Search ..... 108/11, 38, 41, 108/35, 34, 3 C, 14, 48, 33, 36; 297/129, 17; 224/153, 155

[56] References Cited

U.S. PATENT DOCUMENTS

| | | | |
|---|---|---|---|
| 2,755,156 | 7/1956 | Nichols | 108/38 X |
| 2,814,892 | 12/1957 | Larsen | 108/48 |
| 2,992,743 | 7/1961 | Wing | 108/48 |
| 3,094,335 | 6/1963 | Pedro | 297/129 |
| 3,267,879 | 8/1966 | Jackson | 108/11 |
| 3,331,335 | 7/1967 | Warfield | 108/36 X |
| 3,866,547 | 2/1975 | Guyton | 108/38 |
| 4,313,385 | 2/1982 | Fitzgerald | 108/38 |
| 5,411,192 | 5/1995 | Xiao | 108/48 X |
| 5,499,760 | 3/1996 | Pielocik | 297/129 X |

*Primary Examiner*—Jose V. Chen

[57] ABSTRACT

A foldable table apparatus includes a back panel assembly, a table surface panel assembly, and a leg assembly. More specifically, the back panel assembly includes a leg portion, a table-surface-panel support portion connected to the leg portion, and a top back panel portion connected to the leg portion. The table surface panel assembly includes a back-panel-connector portion and a table surface portion attached to the back-panel-connector portion. The leg assembly is connected to a distal portion of the table surface panel assembly. The leg assembly is foldable with respect to the table surface panel assembly. A pair of linkage assemblies are connected between the back panel assembly and the table surface panel assembly. A pair of leg-to-table hinge assemblies are connected between the distal portion of the table surface panel assembly and the leg assembly. A lock assembly is connected between the back panel assembly and the table surface panel assembly for retaining the table surface panel assembly in a folded orientation with respect to the back panel assembly. The top back panel portion of the back panel assembly includes a top back-panel-to-container connector portion. Also, a foldable table and container apparatus includes a foldable table apparatus, such as described above, and a container assembly for storing the foldable table apparatus. In addition, container-to-table retainers, located within the container assembly, are provided for connecting the foldable table apparatus to the container assembly.

14 Claims, 3 Drawing Sheets

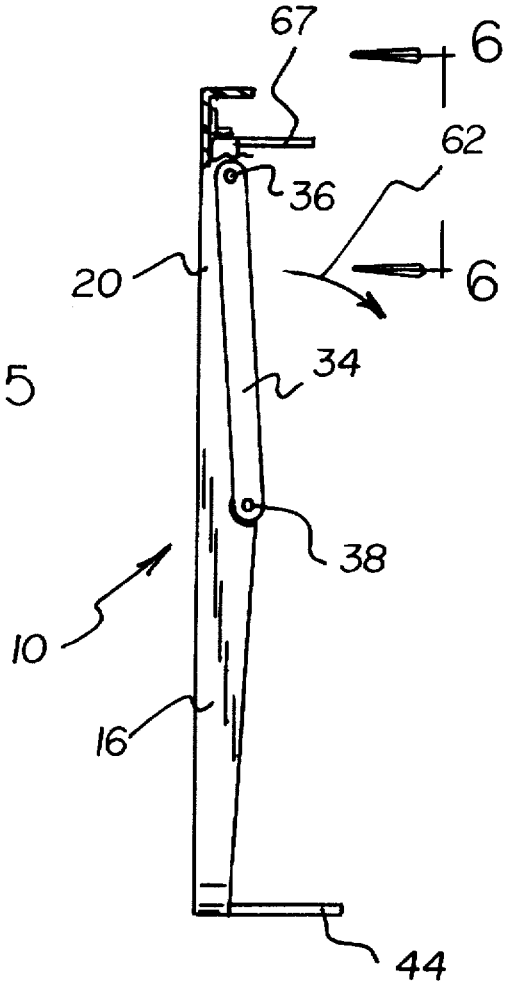
FIG 5
FIG 6
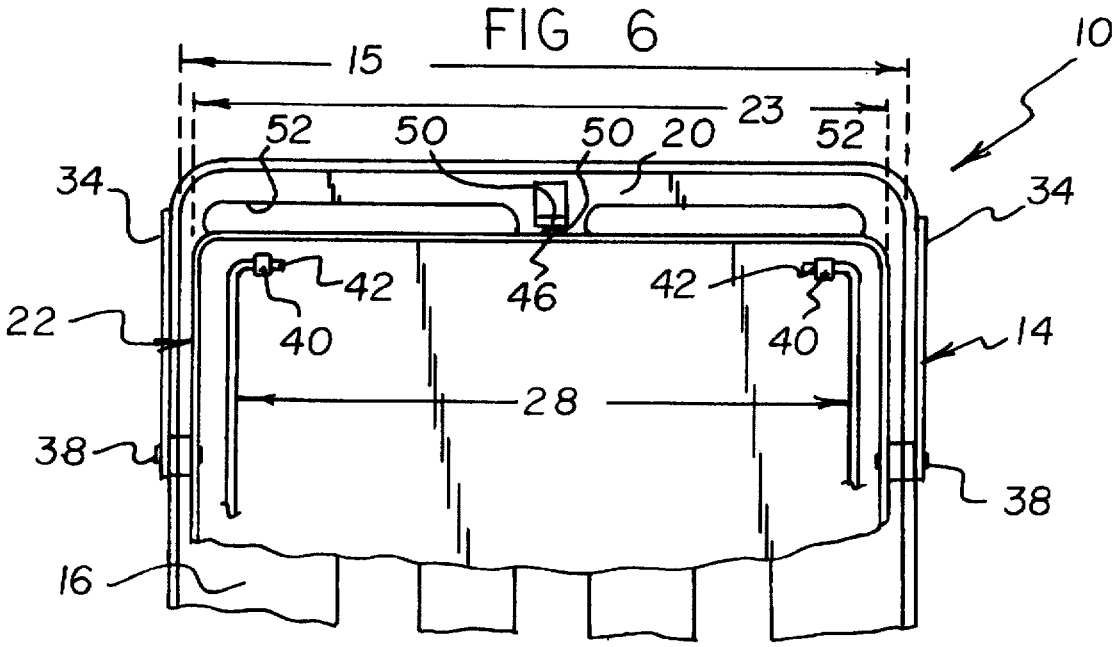

FOLDABLE TABLE AND BACKPACK APPARATUS

BACKGROUND OF THE INVENTION

1. Field of the Invention

The present invention relates generally to foldable tables and backpacks associated with the foldable tables.

2. Description of the Prior Art

Foldable tables are well known in the art. In addition, backpacks are also well known in the art. However, there is one U.S. patent in the art which. is of special interest for its disclosure of a foldable table closely associated with a backpack, and that patent is U.S. Pat. No. 5,411,192 of the present inventor. The many advantages of the tote bag and table apparatus disclosed in U.S. Pat. No. 5,411,192 are amply described in that patent, and U.S. Pat. No. 5,411,192 is incorporated herein by reference. In this respect, the present patent can be regarded as an improvement of the apparatus disclosed in U.S. Pat. No. 5,411,192.

More specifically, U.S. Pat. No. 5,411,192 provides a table assembly which must be leaning up against an underlying vertically extending structure in order for the table assembly to be supported in a horizontal orientation. For example, the table assembly in U.S. Pat. No. 5,411,192 may lean up against the tote bag, a back of an automobile seat, and a vehicle dashboard. However, the table assembly in U.S. Pat. No. 5,411,192 is not free standing. However, there may be times when it would be desirable for a table assembly to be independent of an underlying vertically extending structure so that the table assembly can be free standing.

On the other hand, as indicated in U.S. Pat. No. 5,411,192, the association of a table assembly with a tote bag or backpack has a number of desirable benefits. In this respect, it would be desirable if a free-standing table assembly were provided that can be associated with a backpack. Moreover, when a table is associated with a backpack, it would desirable if the table fits inside the backpack when the table is no longer in use. In addition, when such a table fits inside the backpack, it would be desirable if the table is secured within the backpack so that the backpack has a maximum of internal storage space, even with the table inside the backpack.

As shown in U.S. Pat. No. 5,411,192, the table assembly therein is associated with a backpack that has an access opening at the top of the backpack. There are other backpacks, however, that have access openings at the side of the backpacks. In this respect, it would be desirable if a table assembly were associated with a backpack that has an access opening at the side of the backpack.

Still other features would be desirable in a foldable table and backpack apparatus. When a foldable table assembly is associated with backpack that has a side access opening, it would be desirable if the table assembly were associated with the backpack in such a way that both a top portion and a bottom portion of the table assembly were connected to the backpack simultaneously. Such a connection to the backpack provides good stabilization of the table assembly to the backpack.

Thus, while the foregoing body of prior art indicates it to be well known to use a foldable table assembly associated with a backpack, the prior art described above does not teach or suggest a foldable table and backpack apparatus which has the following combination of desirable features: (1) has a table assembly that can be free standing; (2) has a free-standing table assembly that can be associated with a backpack; (3) has a table that fits inside the backpack when the table is no longer in use; (4) has a table that can be secured within the backpack so that the backpack has optimized internal storage space with the table inside the backpack; (5) has a table associated with a backpack which has an access opening at the side of the backpack; and (6) has a table assembly that is associated with a backpack in such a way that both a top portion and a bottom portion of the table assembly are connected to the backpack simultaneously. The foregoing desired characteristics are provided by the unique foldable table and backpack apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a foldable table apparatus which includes a back panel assembly, a table surface panel assembly, and a leg assembly. More specifically, the back panel assembly includes a leg portion, a table-surface-panel support portion connected to the leg portion, and a top back panel portion connected to the leg portion. The table surface panel assembly includes a back-panel-connector portion and a table surface portion attached to the back-panel-connector portion. The leg assembly is connected to a distal portion of the table surface panel assembly. The leg assembly is foldable with respect to the table surface panel assembly.

A pair of linkage assemblies are connected between the back panel assembly and the table surface panel assembly. Each of the linkage assemblies includes a link member, a first linker hinge connected between the link member and the back panel assembly, and a second linker hinge connected between the link member and the table surface panel assembly. The back panel assembly has back-panel width, the table surface panel assembly has a table-surface width, and the table-surface width is less than the back-panel width, such that the table surface panel assembly is nested within the back panel assembly when the table surface panel assembly is folded with respect to the back panel assembly.

The table-surface-panel support portion includes a pair of L-shaped back-panel brackets, and the back-panel-connector portion includes a pair of complementary L-shaped table-surface-panel brackets that are complementary to the back-panel brackets and interfit with the back-panel brackets when the table surface panel assembly is oriented at a horizontal orientation with respect to the back panel assembly.

A pair of leg-to-table hinge assemblies are connected between the distal portion of the table surface panel assembly and the leg assembly. The leg-to-table hinge assemblies include leg-member-receiving brackets attached to a bottom portion of the table surface panel assembly. The leg-member-receiving brackets receive complementary end portions of the leg assembly.

A lock assembly is connected between the back panel assembly and the table surface panel assembly for retaining the table surface panel assembly in a folded orientation with respect to the back panel assembly. The lock assembly includes a lock bump attached to an outside rim portion of the table surface panel assembly, and a latch member is connected to the back panel assembly for engaging the lock bump when the table surface panel assembly is in a folded orientation with respect to the back panel assembly.

The top back panel portion of the back panel assembly includes a top back-panel-to-container connector portion. The top back-panel-to-container connector portion is a top connector bar defined by a top slot. The back panel assembly,further includes a transverse foot portion which extends horizontally from a distal portion of the back panel assembly in a direction toward the leg assembly. The transverse foot portion includes a bottom back-panel-to-container connector portion. The bottom back-panel-to-container connector portion is a bottom connector bar defined by a bottom slot.

In accordance with another aspect of the invention, a foldable table and container apparatus includes a foldable table apparatus, such as described above, and a container assembly for storing the foldable table apparatus. In addition, container-to-table retainers, located within the container assembly, are provided for connecting the foldable table apparatus to the container assembly. More specifically, the top back panel portion of the back panel assembly includes a top back-panel-to-container connector portion, and the top back-panel-to-container connector portion is a top connector bar defined by a top slot. The back panel assembly further includes a transverse foot portion which extends horizontally from a distal portion of the back panel assembly in a direction toward the leg assembly. The transverse foot portion includes a bottom back-panel-to-container connector portion, and the bottom back-panel-to-container connector portion is a bottom connector bar defined by a bottom slot. The container-to-table retainers include top straps for connecting to the top connector bar and includes a bottom strap for connecting to the bottom connector bar.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved foldable table and backpack apparatus which has all of the advantages of the prior art and none of the disadvantages.

It is another object of the present invention to provide a new and improved foldable table and backpack apparatus which may be easily and efficiently manufactured and marketed.

It is a further object of the present invention to provide a new and improved foldable table and backpack apparatus which is of durable and reliable construction.

An even further object of the present invention is to provide a new and improved foldable table and backpack apparatus which is susceptible of a low cost of manufacture with regard to both materials and labor, and which accordingly is then susceptible of low prices of sale to the consuming public, thereby making such foldable table and backpack apparatus available to the buying public.

Still yet a further object of the present invention is to provide a new and improved foldable table and backpack apparatus which has a table assembly that can be free standing.

Still another object of the present invention is to provide a new and improved foldable table and backpack apparatus that has a free-standing table assembly that can be associated with a backpack.

Yet another object of the present invention is to provide a new and improved foldable table and backpack apparatus which has a table that fits inside the backpack when the table is no longer in use.

Even another object of the present invention is to provide a new and improved foldable table and backpack apparatus that has a table that can be secured within the backpack so that the backpack has optimized internal storage space with the table inside the backpack.

Still a further object of the present invention is to provide a new and improved foldable table and backpack apparatus which has a table associated with a backpack which has an access opening at the side of the backpack.

Yet another object of the present invention is to provide a new and improved foldable table and backpack apparatus that has a table assembly that is associated with a backpack in such a way that both a top portion and a bottom portion of the table assembly are connected to the backpack simultaneously.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 5 is a partially broken away side view of the table assembly of FIG. 4 in folded-table orientation.

FIG. 6 is rear view of a portion of the embodiment of the invention shown in FIG. 5, partially broken away, taken along line 6—6 of FIG. 5.

DESCRIPTION OF THE PREFERRED EMBODIMENT

With reference to the drawings, a new and improved foldable table and backpack apparatus embodying the principles and concepts of the present invention will be described.

Figure 1:
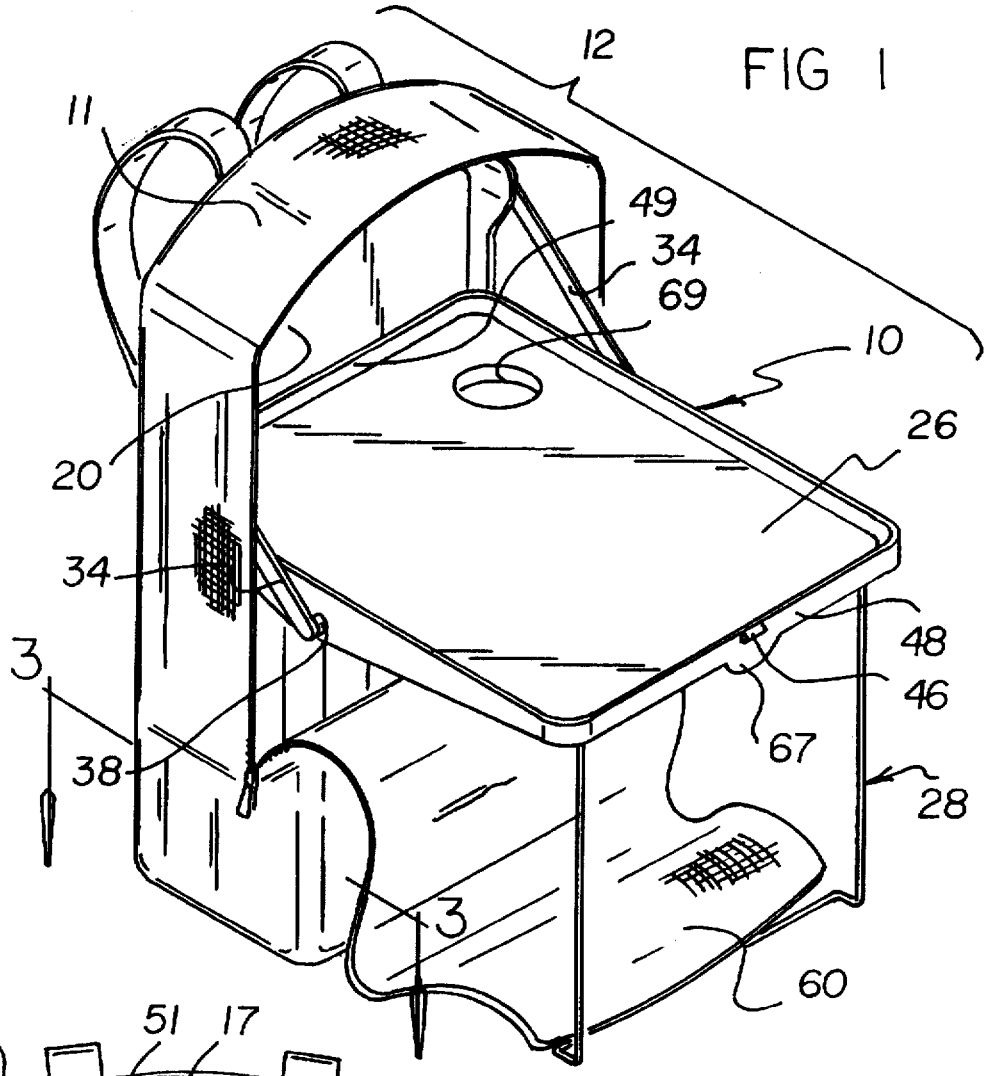
FIG. 1 is a perspective view showing a preferred embodiment of the foldable table and backpack apparatus of the invention with a foldable table assembly associated with a backpack that has a side access opening.
Figure 4:
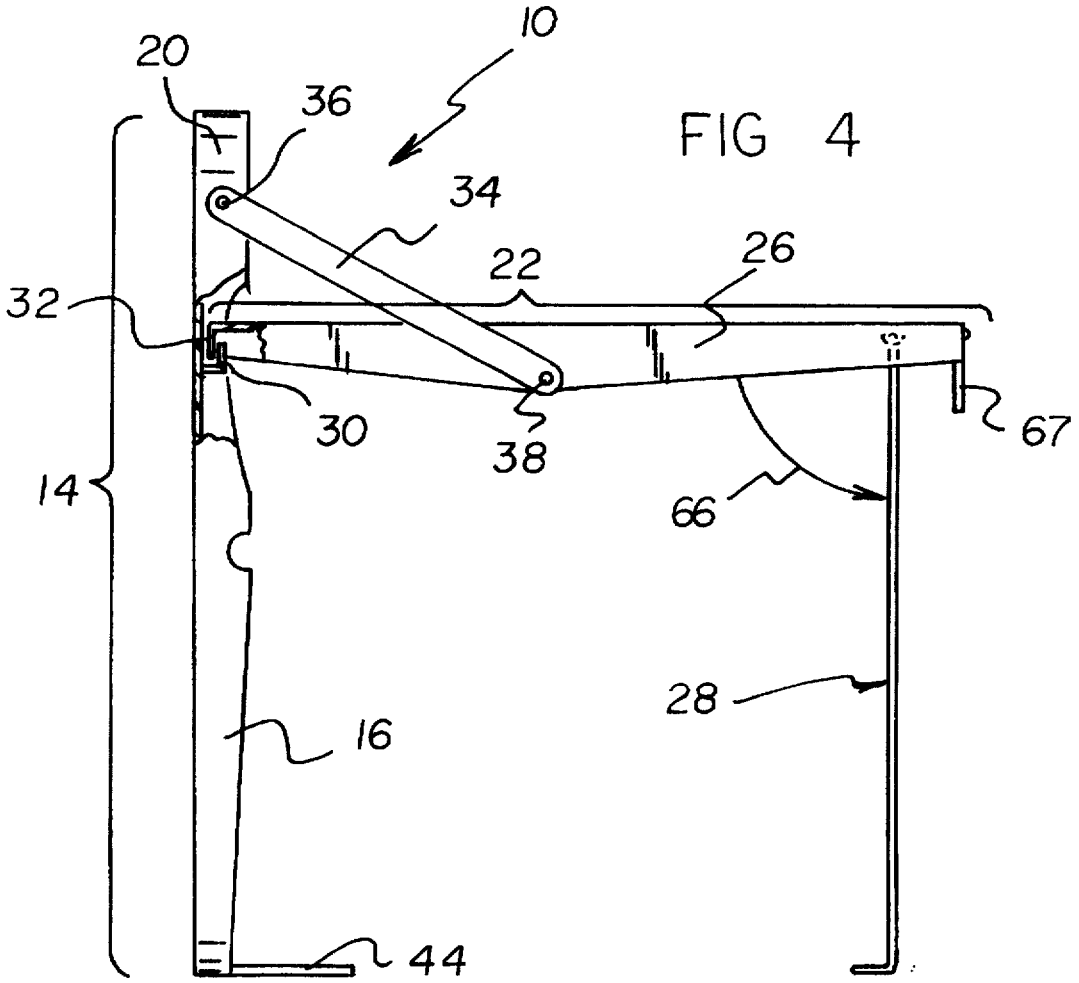
FIG. 4 is an enlarged side view of a free-standing table assembly of the; invention separated from the backpack and in an erected-table orientation.

Turning to FIGS. 4–6, there is shown an exemplary embodiment of the foldable table apparatus of the invention generally designated by reference numeral 10. In its preferred form, foldable table apparatus 10 includes a back panel assembly 14, a table surface panel assembly 22, and a leg assembly 28. More specifically, the back panel assembly 14 includes a leg portion 16, a table-surface-panel support portion connected to the leg portion 16, and a top back panel portion 20 connected to the leg portion 16. The table surface panel assembly 22 includes a back-panel-connector portion and a table surface portion 26 attached to the back-panel-connector portion. The leg assembly 28 is connected to a distal portion of the table surface panel assembly 22. The leg assembly 28 is foldable with respect to the table surface panel assembly 22. The table surface portion 26 includes a well 69 (as shown in FIG. 1, for receiving a beverage can or other container.

A pair of linkage assemblies are connected between the back panel assembly 14 and the table surface panel assembly 22. Each of the linkage assemblies includes a link member 34, a first linker hinge 36 connected between the link member 34 and the back panel assembly 14, and a second linker hinge 38 connected between the link member 34 and the table surface panel assembly 22. The back panel assembly 14 has back-panel width 15, the table surface panel assembly 22 has a table-surface width 23, and the table-surface width 23 is less than the back-panel width 15, such that the table surface panel assembly 22 is nested within the back panel assembly 14 when the table surface panel assembly 22 is folded with respect to the back panel assembly 14.

The table-surface-panel support portion includes a pair of L-shaped back-panel brackets 30, and the back-panel-connector portion includes a pair of complementary L-shaped table-surface-panel brackets 32 that are complementary to the back-panel brackets 30 and interfit with the back-panel brackets 30 when the table surface panel assembly 22 is oriented at a horizontal orientation with respect to the back panel assembly 14.

A pair of leg-to-table hinge assemblies are connected between the distal portion of the table surface panel assembly 22 and the leg assembly 28. The leg-to-table hinge assemblies include leg-member-receiving brackets 40 attached to a bottom portion of the table surface panel assembly 22. The leg-member-receiving brackets 40 receive complementary end portions 42 of the leg assembly 28.

A lock assembly is connected between the back panel assembly 14 and the table surface panel assembly 22 for retaining the table surface panel assembly 22 in a folded orientation with respect to the back panel assembly 14. The lock assembly includes a lock bump 46 attached to an outside rim portion 48 of the table surface panel assembly 22, and a latch member 50 is connected to the back panel assembly 14 for engaging the lock bump 46 when the table surface panel assembly 22 is in a folded orientation with respect to the back panel assembly 14. The outside rim portion 48 has an easily grasped handle portion 67. The top back panel portion 20 of the back panel assembly 14 includes a top back-panel-to-container connector portion. The top back-panel-to-container connector portion is a top connector bar 51 defined by a top slot 52. The back panel assembly 14 further includes a transverse foot portion 44 which extends horizontally from a distal portion of the back panel assembly 14 in a direction toward the leg assembly 28. The transverse foot portion 44 includes a bottom back-panel-to-container connector portion. The bottom back-panel-to-container connector portion is a bottom connector bar 53 defined by a bottom slot 54.

Figure 2:
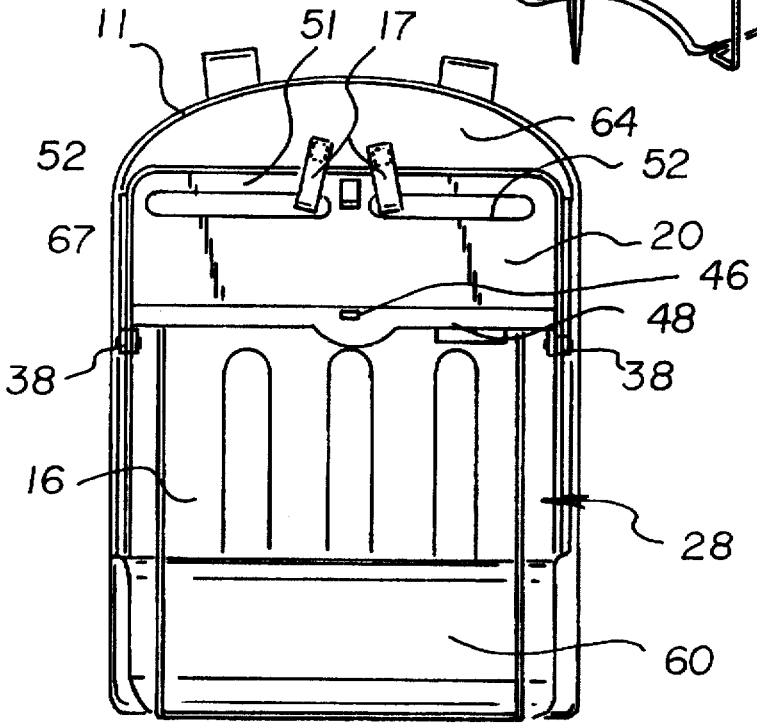
FIG. 2 is a rear view of the embodiment of the foldable table and backpack apparatus shown in FIG. 1.
Figure 3:
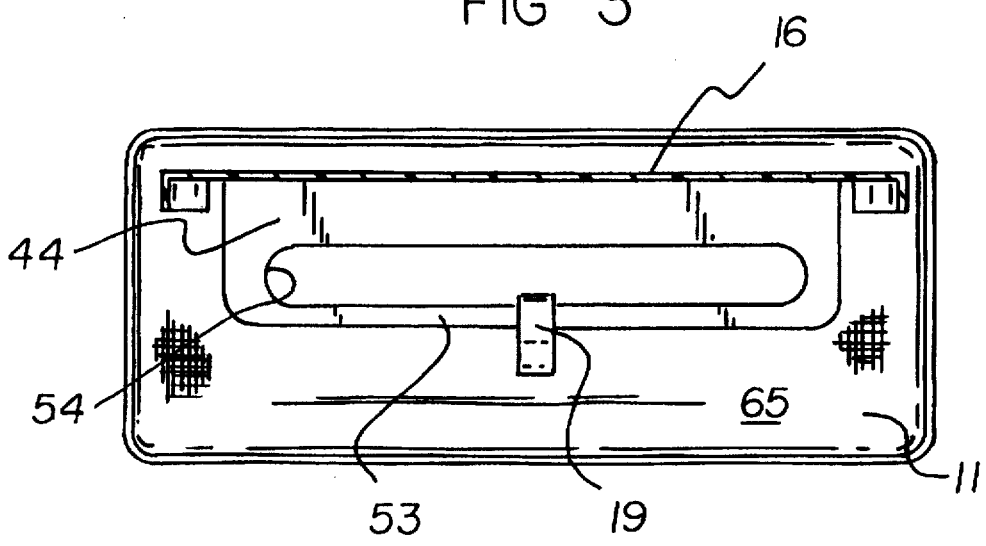
FIG. 3 is a cross-sectional view of the embodiment of the foldable table and backpack apparatus of FIG. 1 taken along line 3—3 thereof.

In accordance with another aspect of the present invention, as shown in FIGS. 1–3, a foldable table and container apparatus 12 includes a foldable table apparatus 10, such as described above, and a container assembly 11 for storing the foldable table apparatus 10. In addition, container-to-table retainers, located within the container assembly 11, are provided for connecting; the foldable table apparatus 10 to the container assembly 11. More specifically, the top back panel portion 20 of the back panel assembly 14 includes a top back-panel-to-container connector portion, and the top back-panel-to-container connector portion is a top connector bar 51 defined by a top slot 52. The back panel assembly 14 further includes a transverse foot portion 44 which extends horizontally from a distal portion of the back panel assembly 14 in a direction toward the leg assembly 28. The transverse foot portion 44 includes a bottom back-panel-to-container connector portion, and the bottom back-panel-to-container connector portion is a bottom connector bar 53 defined by a bottom slot 54. The container-to-table retainers include top straps 17 for connecting to the top connector bar 51 and includes a bottom strap 19 for connecting to the bottom connector bar 53. The top straps 17 and the bottom strap 19 include complementary hook-and-loop connection material, such as VELCRO(TM), for affixing the top straps 17 to the top connector bar 51 and for affixing the bottom strap 19 to the bottom connector bar 53. The bottom strap 19 is located on the bottom wall 65 of the backpack 11.

As shown in FIG. 1, an embodiment of the foldable table and container apparatus 12 of the invention is shown wherein the container assembly 11 is in a form of a backpack 11. As shown in FIG. 1, the backpack: 11 opens from the side whereby access is gained into the interior of the backpack 11. As shown, a side panel 60 is unzipped, and the foldable table apparatus 10 is oriented into a horizontal-table-surface orientation. To accomplish this horizontal-table-surface orientation, attention is directed to FIG. 5 which shows the foldable table apparatus 10 in a folded-up orientation. To convert the foldable table apparatus 10 from the folded-up orientation to the horizontal-table-surface orientation, the outside rim portion 48 of the table surface panel assembly 22 is grasped and pulled in a clockwise direction as shown by arrow 62 in FIG. 5. When this occurs, the link members 34 swing around the first linker hinges 36 and the second linker hinges 38, the outside rim portion 48 of the table surface panel assembly 22 swings downward, and the inside rim portion 49 of the table surface panel assembly 22 swings upward. The table-surface-panel brackets 32 are swung up past the back-panel brackets 30, and the table-surface-panel brackets 32 are lowered onto the back-panel brackets 30 to engage them. This engagement helps retain the table surface panel assembly 22 in a horizontal orientation. In the horizontal orientation, the inside rim portion 49 of the table surface panel assembly 22 rests against the back wall 64 of the backpack 11. With the table surface panel assembly 22 in the horizontal orientation, the leg assembly 28 is swung in a counterclockwise direction, as shown by arrow 66 shown in FIG. 4. When the leg assembly 28 is oriented vertically as shown in FIG. 4, both the inside rim portion 49 and the outside rim portion 48 of the table surface panel assembly 22 are supported in the horizontal orientation.

The foldable table apparatus 10 is retained in the backpack 11 by the top straps 17 on the top connector bar 51 and by the bottom strap 19 on the bottom connector bar 53. The foldable table apparatus 10 can be folded with the foldable table apparatus 10 still retained in the backpack 11. When this is done, the foldable table apparatus 10 is in a compact form and permits an optimum amount of space to be available for storage in the backpack 11.

As shown in FIG. 4, when the top straps 17 are removed from the top connector bar 51, and When the bottom strap 19 is removed from the bottom connector bar 53, the foldable table apparatus 10 can be separated from the backpack 11. When this is done, the foldable table apparatus 10 is free standing, as shown in FIG. 4.

The components of the foldable table and backpack apparatus of the invention can be made from inexpensive and durable metal, fabric and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved foldable table and backpack apparatus that is low in cost, relatively simple in design and operation, and which may advantageously be used with a table assembly that can be free standing. With the invention, a foldable table and backpack apparatus is provided which has a free-standing table assembly that can be associated with a backpack. With the invention, a foldable table and backpack apparatus is provided which has a table that fits inside the backpack when the table is no longer in use. With the invention, a foldable table and backpack apparatus is provided which has a table that can be secured within the backpack so that the backpack has optimized internal storage space with the table inside the backpack. With the invention, a foldable table and backpack apparatus is provided which has a table associated with a backpack which has an access opening at the side of the backpack. With the invention, a foldable table and backpack apparatus is provided which has a table assembly that is associated with a backpack in such a way that both a top portion and a bottom portion of the table assembly are connected to the backpack simultaneously.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the foregoing Abstract provided at the beginning of this specification is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A foldable table apparatus, comprising:

a back panel assembly which includes a leg portion, a table-surface-panel support portion connected to said leg portion, and a top back panel portion connected to said leg portion, a table surface panel assembly which includes a back-panel-connector portion and a table surface portion attached to said back-panel-connector portion, and a leg assembly connected to a distal portion of said table surface panel assembly, wherein said leg assembly is foldable with respect to said table surface panel assembly, wherein said top back panel portion of said back panel assembly includes a top back-panel-to-container connector portion for connecting said foldable table apparatus to a container therefore, and, wherein said top back-panel-to-container connector portion is a top connector bar defined by a top slot in said top back-panel-to-container connector portion, said top connector bar being adapted to be releasably connected to said container for said foldable table apparatus.

2. The apparatus of claim 1, further including:

a pair of linkage assemblies connected between said back panel assembly and said table surface panel assembly.

3. The apparatus of claim 2 wherein each of said linkage assemblies includes:

a link member, a first linker hinge connected between said link member and said back panel assembly, and a second linker hinge connected between said link member and said table surface panel assembly.

4. The apparatus of claim 1 wherein:

said back panel assembly has back-panel width, said table surface panel assembly has a table-surface width, and said table-surface width is less than said back-panel width, such that said table surface panel assembly is nested within said back panel assembly when said table surface panel assembly is folded with respect to said back panel assembly.

5. The apparatus of claim 1 wherein:

said table-surface-panel support portion includes a pair of L-shaped back-panel brackets, and said back-panel-connector portion includes a pair of complementary L-shaped table-surface-panel brackets that are complementary to said back-panel brackets and interfit with said back-panel brackets when said table surface panel assembly is oriented at a horizontal orientation with respect to said back panel assembly.

6. The apparatus of claim 1, further including:

a pair of leg-to-table hinge assemblies connected between said distal portion of said table surface panel assembly and said leg assembly.

7. The apparatus of claim 6 wherein said leg-to-table hinge assemblies include leg-member-receiving brackets attached to a bottom portion of said table surface panel assembly, wherein said leg-member-receiving brackets receive complementary end portions of said leg assembly.

8. The apparatus of claim 1, further including:

a lock assembly connected between said back panel assembly and said table surface panel assembly for retaining said table surface panel assembly in a folded orientation with respect to said back panel assembly.

9. The apparatus of claim 8 wherein said lock assembly includes:

a lock bump attached to an outside rim portion of said table surface panel assembly, and a latch member connected to said back panel assembly for engaging said lock bump when said table surface panel assembly is in a folded orientation with respect to said back panel assembly.

10. The apparatus of claim 1 wherein said back panel assembly further includes a transverse foot portion which extends horizontally from a distal portion of said back panel assembly in a direction toward said leg assembly.

11. The apparatus of claim 10 wherein said transverse foot portion includes a bottom back-panel-to-container connector portion.

12. The apparatus of claim 11 wherein said bottom back-panel-to-container connector portion is a bottom connector bar defined by a bottom slot.

13. A foldable table and container apparatus, comprising:

a foldable table apparatus of claim 1, and a container assembly for storing said foldable table apparatus, and container-to-table retainers, located within said container assembly, for connecting said foldable table apparatus to said container assembly.

14. The apparatus of claim 13 wherein:

said back panel assembly further includes a transverse foot portion which extends horizontally from a distal portion of said back panel assembly in a direction toward said leg assembly, said transverse foot portion includes a bottom back-panel-to-container connector portion, and said bottom back-panel-to-container connector portion is a bottom connector bar defined by a bottom slot, said container-to-table retainers include top straps for connecting to said top connector bar and include a bottom strap for connecting to said bottom connector bar.

* * * * *